US008622529B2

(12) United States Patent
Togashi

(10) Patent No.: US 8,622,529 B2
(45) Date of Patent: Jan. 7, 2014

(54) LIQUID EJECTING HEAD AND LIQUID EJECTING APPARATUS

(75) Inventor: Isamu Togashi, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/549,837

(22) Filed: Jul. 16, 2012

(65) Prior Publication Data

US 2013/0021413 A1 Jan. 24, 2013

(30) Foreign Application Priority Data

Jul. 20, 2011 (JP) ..... 2011-158838

(51) Int. Cl.
*B41J 2/045* (2006.01)

(52) U.S. Cl.
USPC ..... 347/70; 347/68; 347/71; 347/72

(58) Field of Classification Search
USPC ..... 347/68–72
See application file for complete search history.

(56) References Cited

U.S. PATENT DOCUMENTS 5,424,769 A * 6/1995 Sakai et al. ..... 347/70
5,710,584 A 1/1998 Suzuki et al.

FOREIGN PATENT DOCUMENTS

JP 07-195689 8/1995

* cited by examiner

*Primary Examiner* — Henok Legesse
(74) *Attorney, Agent, or Firm* — Harness, Dickey & Pierce, P.L.C.

(57) ABSTRACT

A diaphragm unit includes an elastic film unit which seals an opening portion of a pressure chamber, and an island unit which is provided on the elastic film unit and to which a tip portion of a piezoelectric vibrator is joined. The width of the center portion of the island unit in the longitudinal direction is set to be narrower than the width of both end portions of the island unit in the longitudinal direction. The dimension of the center portion of the island unit in the longitudinal direction is shorter than the dimension of the piezoelectric vibrator in the same direction.

4 Claims, 6 Drawing Sheets

LIQUID EJECTING HEAD AND LIQUID EJECTING APPARATUS

BACKGROUND

1. Technical Field

The present invention relates to a liquid ejecting head such as an ink jet type recording head, and a liquid ejecting apparatus including the same, and in particular, a liquid ejecting head and a liquid ejecting apparatus ejecting liquid from a nozzle by displacing an island unit of a diaphragm unit partitioning a part of a pressure chamber, using a piezoelectric vibrator.

2. Related Art

A liquid ejecting apparatus includes a liquid ejecting head which is capable of ejecting liquid as droplets, and is an apparatus which ejects various kinds of liquids from the liquid ejecting head. As a representative apparatus of the liquid ejecting apparatus, for example, an image recording apparatus can be exemplified such as an ink jet type recording apparatus (printer) that includes an ink jet type recording head (hereinafter, referred to as a recording head), and ejects liquid ink as ink droplets from the recording head and performs recording. In recent years, liquid ejecting apparatuses are also applied to various kinds of manufacturing apparatuses such as a display manufacturing apparatus without being limited to the image recording apparatus.

As the ink jet type printer (hereinafter, simply referred to as the printer) which is a kind of liquid ejecting apparatus, there is a printer having a configuration which fluctuates the volume of a pressure chamber by displacing a diaphragm unit partitioning a part (opening surface) of the pressure chamber, using a piezoelectric vibrator to generate pressure fluctuation in the ink inside the pressure chamber and ejecting the ink from a nozzle (for example, refer to JP-A-07-195689).

The diaphragm unit includes a flexible film which seals the opening surface of the pressure chamber, and an island unit which is provided on this flexible film. This island unit is generally made of a rigid body such as a metal or the like formed in an approximately rectangular parallelepiped shape, and is a part which is joined to the tip of the piezoelectric vibrator. The flexible film around the island unit functions as an elastic film unit. When the piezoelectric vibrator is displaced in an expandable manner, the island unit is displaced towards the side away from the pressure chamber, or the island unit is displaced towards the side close to the inside of the pressure chamber, and accordingly the volume of the pressure chamber is fluctuated. It is configured that the pressure fluctuation of the ink in the pressure chamber is generated by the volume fluctuation of the pressure chamber, and the ink is ejected from the nozzle using this pressure fluctuation. Since the displacement of the piezoelectric vibrator is extremely small (for example, several tens of nm), it is preferable that the displacement of the piezoelectric vibrator be efficiently converted to the volume fluctuation of the pressure chamber.

In recent years, a plurality of nozzles are arranged with a high density in various printers to respond to the image quality improvement of the recording image. Accordingly, the pressure chambers which communicate with each of the nozzles are also formed with a high density. As a result, the dimensions of the piezoelectric vibrator, particularly the dimension in the nozzle array direction, tend to be small so that the rigidity of the piezoelectric vibrator is degraded. A piezoelectric vibrator with low rigidity tends to be deformed by receiving a reaction force when the island unit is displaced, and thus a failure in ejecting the ink may occur. Specifically, if the piezoelectric vibrator is easily deformed, the volume fluctuation of the pressure chamber is not sufficiently performed, and ejection properties (ink amount, flying speed or the like) of the ink ejected from the nozzles may fluctuate. Further, if the piezoelectric vibrator is easily deformed, an increase of the compliance (the degree of tendency to be deformed or softness per unit area) may occur by the same amount. If the compliance is increased, it is concerned that the meniscus vibration may be increased after ejecting the ink, and this vibration may exert a negative influence on the ejection properties.

Such problems exist not only in the ink jet type recording apparatus to which the ink jet type recording head ejecting the ink droplet is mounted, but also in liquid ejecting apparatuses to which other liquid ejecting heads ejecting liquid droplets other than ink are mounted.

SUMMARY

An advantage of some aspects of the invention is to provide a liquid ejecting head and a liquid ejecting apparatus capable of reducing a reaction force from an island unit using a piezoelectric vibrator when driving the piezoelectric vibrator and preventing a deformation of the piezoelectric vibrator.

According to an aspect of the invention, there is provided a liquid ejecting head including a pressure chamber which communicates with a nozzle, a diaphragm unit which partitions a part of the pressure chamber, and a piezoelectric vibrator which displaces the diaphragm unit wherein the diaphragm unit includes an elastic film unit which seals an opening portion of the pressure chamber, and an island unit which is provided on the elastic film unit and to which a tip portion of the piezoelectric vibrator is joined, the width of a center portion of the island unit in the longitudinal direction is set to be narrower than the width of both end portions of the island unit in the longitudinal direction, and the dimension of the center portion of the island unit in the longitudinal direction is shorter than the dimension of the piezoelectric vibrator in the same direction.

According the configuration, since the width of the center portion of the island in the longitudinal direction is set to be narrower than the width of both end portions of the island unit in the longitudinal direction, a reaction force received from the island unit when the piezoelectric vibrator expands and contracts, particularly a reaction force in the center portion can be reduced. That is, by employing this configuration, the area of the elastic film unit is widened to the degree the width of the center portion of the island unit is narrowed, and the reaction force when the piezoelectric vibrator expands and contracts is easily absorbed by the elastic deformation of the elastic film unit. Accordingly, the reaction force with respect to the piezoelectric vibrator may be reduced. As a result, the deformation of the piezoelectric vibrator due to the reaction force is prevented, and the negative influence on the ejection properties due to the deformation of the piezoelectric vibrator can be suppressed. Meanwhile, since the width of both end portions of the island unit is wider than the width of the center portion, the displacement of the piezoelectric vibrator in an expandable manner can be efficiently converted to the volume fluctuation of the pressure chamber. Thus, the desired amount of the liquid can be ejected from the nozzle.

The dimension of the center portion of the island unit in the longitudinal direction is set shorter than the dimension of the piezoelectric vibrator in the same direction, the piezoelectric vibrator is more reliably joined to both end portions of the island unit even in a case where the position of the piezoelectric vibrator with respect to the island unit is slightly shifted in the longitudinal direction of the island unit by the manufacturing error, product size error or the like. Accordingly, the displacement of the piezoelectric vibrator in an expandable manner is more reliably delivered with respect to the island unit, and the volume fluctuation of the pressure chamber can be performed properly.

According to another aspect of the invention, there is provided a liquid ejecting head including a pressure chamber which communicates with a nozzle, a diaphragm unit which partitions a part of the pressure chamber, and a piezoelectric vibrator which displaces the diaphragm unit, wherein the diaphragm unit includes an elastic film unit which seals an opening portion of the pressure chamber, and an island unit which is provided on the elastic film unit and to which a tip portion of the piezoelectric vibrator is joined, and in the center portion of the joint surface of the island unit with the piezoelectric vibrator, a recessed portion is formed on the opposite surface side of the joint surface side.

According the configuration, since the recessed portion is formed in the center portion of the joint surface of the island unit with the piezoelectric vibrator, towards the opposite surface side to the joint surface side, a portion corresponding to the recessed portion of the island unit is not joined to the tip portion of the piezoelectric vibrator. Accordingly, it is possible to reduce the reaction force received from the island unit when the piezoelectric vibrator expands and contracts. As a result, deformation of the piezoelectric vibrator due to the reaction force is prevented, and the adverse influence on the liquid properties due to the deformation of the piezoelectric vibrator can be suppressed. Meanwhile, since the width of both end portions of the island unit is wider than the width of the center portion thereof, the displacement of the piezoelectric vibrator in an expandable manner can be efficiently converted to the volume fluctuation of the pressure chamber. Thus, the desired amount of the liquid can be ejected from the nozzle.

According to still another aspect of the invention, there is provided a liquid ejecting apparatus comprising the liquid ejecting head according to any one of above aspects.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the embodiments for realizing the present invention will be described with reference to accompanying drawings. There are various limitations in the embodiments which will be described below, as preferable specified examples of the invention; however, the invention is not limited to the embodiments unless particularly stating the limitation of the invention. Hereinafter, an ink jet type recording apparatus (hereinafter, a printer) will be exemplified and described as a liquid ejecting apparatus of the invention.

Figure 1:
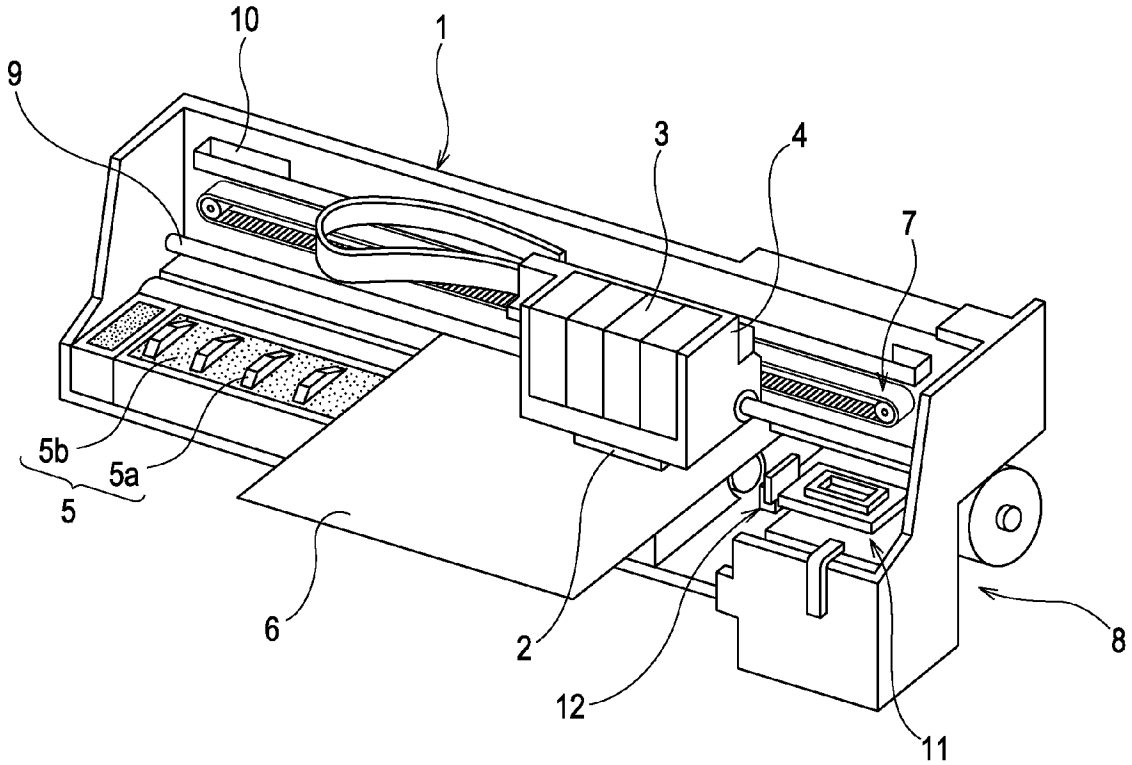
FIG. 1 is a perspective diagram explaining an internal configuration of a printer.

FIG. 1 is a perspective diagram showing a configuration of a printer 1. The printer 1 includes a carriage 4 to which a recording head 2, which is a kind of liquid ejecting head, is attached and an ink cartridge 3, which is a kind of liquid supply source, is detachably attached, a platen 5 which is arranged below the recording head 2 when the recording operation is performed, a carriage movement mechanism 7 which makes the carriage 4 move in a reciprocating manner in the paper width direction of a recording paper 6 (a kind of recording medium and a liquid landing target), that is, in the main scanning direction, and a transporting mechanism 8 which transports the recording paper 6 in the sub-scanning direction that is perpendicular to the main scanning direction.

The carriage 4 is attached to a guide rod 9 laid in the main scanning direction, in a spindle-supported state, and is configured so as to move in the main scanning direction along the guide rod 9 by the operation of the carriage movement mechanism 7. The position of the carriage 4 in the main scanning direction is detected by a linear encoder 10. A home position which is a base point of the scanning of the carriage is set in an end portion region which is outside the recording region of the movement range of the carriage 4. In the home position in the present embodiment, capping member 11 which seals the nozzle formation surface (a nozzle plate 24: see FIG. 2) of the recording head 2, and a wiper member 12 for wiping out the nozzle formation surface are arranged. The printer 1 performs so-called bi-directional recording that records characters or images on the recording paper 6 in both directions, when the carriage 4 moves from the home position towards the end portion which is at the opposite side thereof, and when the carriage 4 returns from the end portion at the opposite side towards the home position side.

The platen 5 is a plate-like member which has longer sides in the main scanning direction, and a plurality of support projections 5*a* are installed on the surface thereof with a predetermined interval along the longitudinal direction. Each of the supporting projections 5*a* protrudes to the upper side (recording head 2 side when operating the recording) than the platen surface. The upper surface of each of the supporting projections 5*a* partially supports the back surface (the surface opposite to the recording surface where the ink lands) of the recording paper 6 as an abutting surface supporting the recording paper 6. An ink absorbing material 5*b* is provided in a portion which is the surface of the platen 5 and is not a part of the supporting projections 5*a*. The ink absorbing material 5*b* is made of a porous member which has absorbability and is manufactured from felt, sponge or the like.

Figure 2:
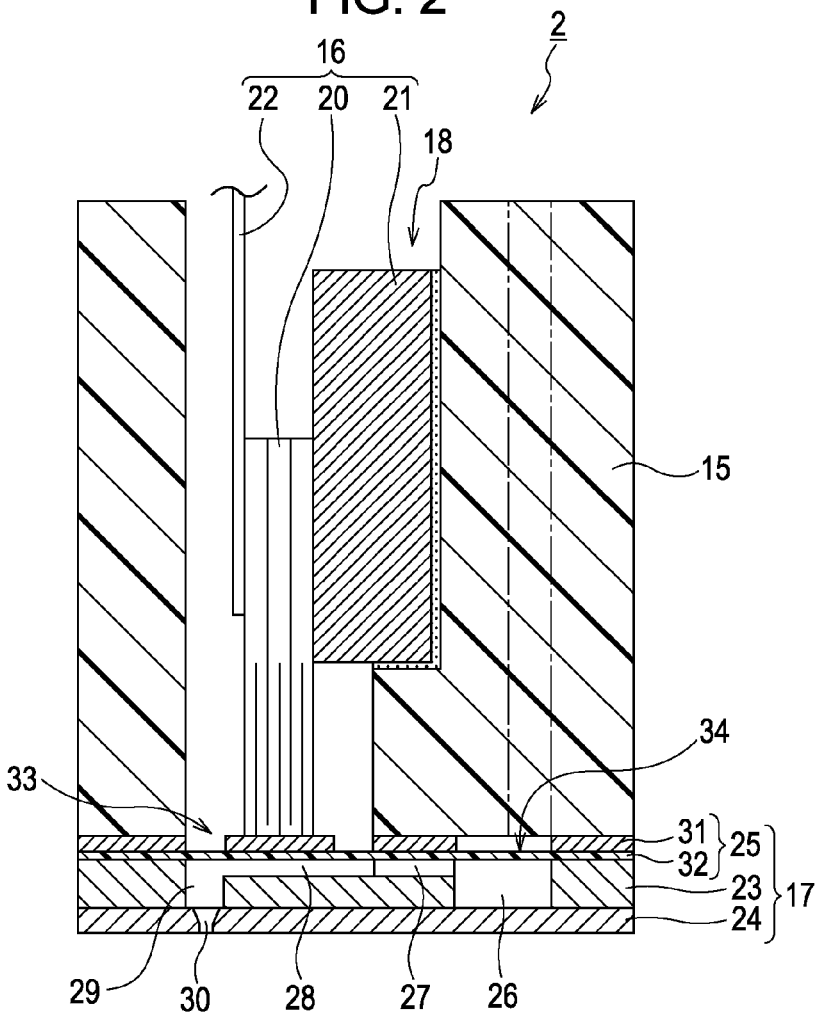
FIG. 2 is a cross-sectional diagram of main parts of a recording head.
Figure 3:
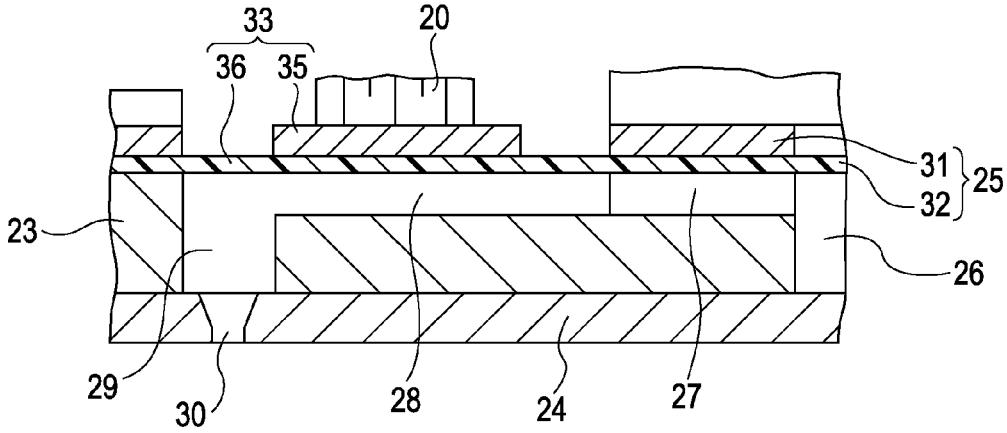
FIG. 3 is a cross-sectional diagram of main parts of the vicinity of a pressure chamber.
Figure 4:
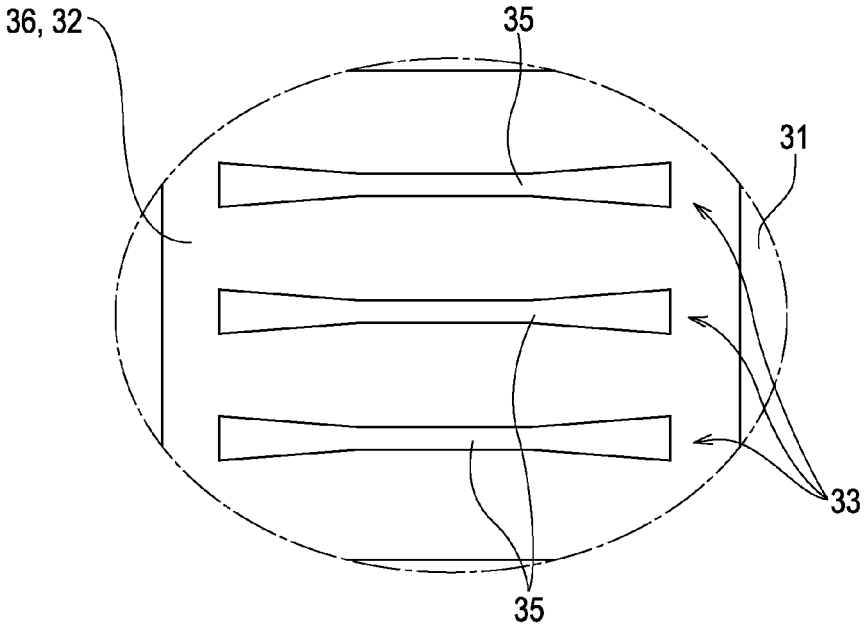
FIG. 4 is an enlarged plane view of the vicinity of a diaphragm unit.

FIG. 2 is a cross-sectional diagram of main parts explaining a configuration of the recording head 2. FIG. 3 is an enlarged cross-sectional diagram of the vicinity of a pressure chamber 28 shown in FIG. 2. FIG. 4 is an enlarged plane view of the vicinity of a diaphragm unit 33 of a vibrating plate 25.

The recording head 2 includes a case 15, a vibrator unit 16 accommodated in the case 15, and a flow path unit 17 joined to the bottom surface (tip surface) of the case 15. The case 15 is manufactured by, for example, epoxy-based resin, and in the inner portion thereof, an accommodation empty portion 18 is formed for accommodating the vibrator unit 16. The vibrator unit 16 includes a plurality of piezoelectric vibrators 20 which function as a kind of pressure generating means, a fixed plate 21 to which the piezoelectric vibrators 20 are joined, and a flexible cable 22 which supplies the driving signal to the piezoelectric vibrators 20. The piezoelectric vibrators 20 are so-called vertical-vibrating type piezoelectric vibrators which are formed by dividing the vibrator base material into the plurality of parts, which is formed by laminating the piezoelectric body across the electrode members alternately.

In the flow path unit 17, the nozzle plate 24 is joined to one surface of a flow path forming substrate 23, and the vibrating plate 25 is joined to the other surface of the flow path forming substrate 23. In the flow path unit 17, a reservoir 26 (common liquid chamber), an ink supply port 27, the pressure chamber 28, a nozzle communicating port 29, and a nozzle 30 are provided. The sequence of an ink flow path (liquid flow path) passing from the ink supply port 27 to the pressure chamber 28 to the nozzle communicating port 29 and approaching the nozzle 30, is formed corresponding to each nozzle 30. The pressure chamber 28 is an elongated empty portion in a direction perpendicular to the nozzle array direction which will be described later, and the upper surface thereof (a surface of the side to which the vibrating plate 25 is joined) is opened. One end portion of the pressure chamber 28 in the longitudinal direction communicates with the nozzle 30 through the nozzle communicating port 29 which passes through the flow path forming substrate 23 in the thickness direction, and the other end portion thereof in the longitudinal direction communicates with the reservoir 26 through the ink supply port 27. The upper opening of the pressure chamber 28 is sealed by the vibrating plate 25. The diaphragm unit 33 which will be described later is arranged in the upper opening of the pressure chamber 28 which is in a sealed state.

The nozzle plate 24 is a thin plate made of metal such as stainless or the like, on which a plurality of nozzles 30 are installed to be penetrated in a row, at a pitch (for example, 180 dpi) corresponding to the dot formation density. In the nozzle plate 24, a plurality of nozzle arrays (nozzle groups) are provided by arranging the nozzles 30 in rows, and one nozzle array is configured by, for example, 180 nozzles 30. The nozzle plate 24 may be manufactured by other materials such as silicon single crystal substrate or the like, in some cases.

The vibrating plate 25 is provided with a double structure in which the flexible film 32 is laminated on the surface of a supporting plate 31. In this embodiment, the vibrating plate 25 is configured by a composite plate which is obtained by laminating the resin film, as the flexible film 32, on the surface of the supporting plate 31 made of a metal plate such as stainless steel. For example, the thickness of the supporting plate 31 is about 30 μm, and the thickness of the flexible film 32 is about 6 μm to 8 μm including the thickness of the adhesive, for example. In the vibrating plate 25, the diaphragm unit 33 which changes the volume of the pressure chamber 28 is formed on a portion of the flow path forming plate 23 corresponding to each of the pressure chambers 28. In a vibrating plate 25, a compliance unit 34 which seals the reservoir 26 is provided on a portion of the flow path forming substrate 23 corresponding to the reservoir 26. The compliance unit 34 is manufactured by removing a region of supporting plate 31 corresponding to the opening surface of the reservoir 26 by the etching process, so as to leave only the flexible film 32 on the corresponding portion. The compliance unit 34 functions as a damper which absorbs the pressure fluctuation of the liquid retained in the reservoir 26.

The diaphragm 33 is manufactured by partially removing the supporting plate 31 through the etching process, similarly to the compliance unit 34. That is, the diaphragm unit 33 includes the island unit 35 to which the tip surface of the piezoelectric vibrator 20 is joined, and an elastic film unit 36 formed of only the flexible film 32 surrounding the periphery of the island unit 35. The elastic film unit 36 is a portion where the support plate 31 is removed with the island unit 35 remaining, over the formation range of the pressure chamber 28.

Figure 5:
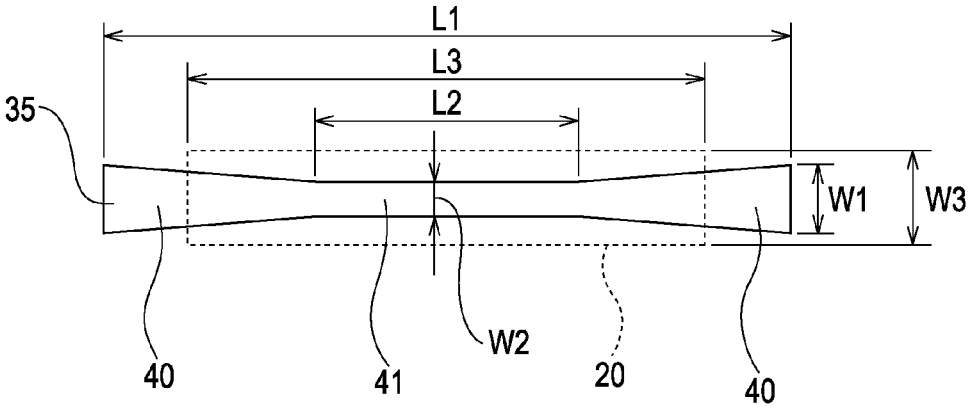
FIG. 5 is a plane view explaining a configuration of an island unit.

FIG. 5 is a plane view explaining a configuration of an island unit 35. The island unit 35 of the embodiment is formed in a block shape with longer sides, which is smaller than the opening shape of the pressure chamber 28. The island unit 35 includes wide width portions 40 respectively formed on both end portions in the longitudinal direction and a narrow width portion 41 formed between both wide width portions 40. The width (dimension in the nozzle array direction) of both wide width portions 40 has gradually been narrowed from the maximum width W1 of the end portion which is on the opposite side to the narrow width portion 41, to the minimum width W2 on the narrow width portion 41 side. The width of the narrow width portion 41 is constant as W2. An entire length L1 of the island unit 35 is set to be longer than a dimension L3 of the piezoelectric vibrator 20 in a direction perpendicular to the nozzle array, and the length L2 of the narrow width portion 41 in the same direction is set to be shorter than the L3. Further, the maximum width W1 of both wide width portions 40 is set to be smaller than the dimension W3 of the piezoelectric vibrator 20 in the nozzle array direction. The maximum width W1 of the wide width portions 40 is similar to or slightly bigger than the width of the island unit of this kind of recording head of the related art, and in this embodiment, is set to 41 μm, for example. Further, the width W2 of the narrow width portion 41 is narrower than the width of the island portion of this kind of recording head in the related art, and in this embodiment, is set to 38 μm, for example. The dimension W3 of the piezoelectric vibrator 20 of the embodiment is 50 μm, for example.

In a state in which the piezoelectric vibrator 20 is positioned with respect to the island unit 35, at least a portion of the piezoelectric vibrator 20 overlaps both end portions of the island unit, respectively. In this state, the tip portion of the piezoelectric vibrator 20 is joined to the island unit 35. Herein, as described above, since the length L2 of the narrow width portion 41 is set to be sufficiently shorter than the dimension L3 of the piezoelectric vibrator, even in a case in which the position of the piezoelectric vibrator 20 with respect to the island unit 35 is slightly shifted to the direction perpendicular to the nozzle array by the manufacturing error or product size error, the piezoelectric vibrator 20 is more reliably joined to both sides of the wide width portions 40. Accordingly, the displacement of the piezoelectric vibrator 20 with respect to the island unit 35 in an expandable manner can be more reliably delivered, and the volume fluctuation of the pressure chamber 28 can be more reliably performed.

Figure 6:
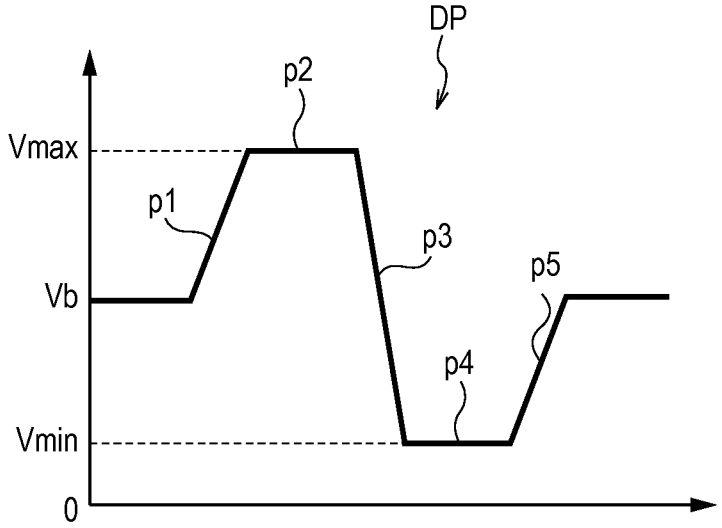
FIG. 6 is a waveform chart explaining a configuration of an ejecting driving pulse.

FIG. 6 is a waveform chart showing an example of a configuration of an ejecting driving pulse DP which drives the piezoelectric vibrator 20 to eject the ink from the nozzles 30. In FIG. 6, the vertical axis shows the electric potential, and the horizontal axis shows the time. The ejecting driving pulse DP includes a dilation element p1 which makes the pressure chamber 28 dilate by changing the electric potential to positive, from the reference electric potential (intermediate electric potential) Vb to the maximum electric potential (maximum voltage) Vmax, a dilation holding element p2 which holds the maximum electric potential Vmax for the constant time period, a contracting element p3 which contracts the pressure chamber 28 rapidly by changing the electric potential to negative, from the maximum electric potential Vmax to the minimum electric potential (minimum voltage) Vmin, a contracting holding (damping held) element p4 which holds the minimum electric potential Vmin for the constant time period, and a returning element p5 which makes the electric potential return from the minimum electric potential Vmin to the reference electric potential Vb. Herein, when the electric potential applied to the piezoelectric vibrator 20 is the reference electric potential Vb, the position of the island unit 35 is positioned in the vicinity of the opening portion of the pressure chamber 28.

The ejecting driving pulse DP acts as follows when it is applied to the piezoelectric vibrator 20. First, the piezoelectric vibrator 20 contracts due to the dilation element p1. Since the island unit 35 is surrounded by the elastic film unit 36, the displacement of the island unit 35 along with the expanding and the contracting of the piezoelectric vibrator 20 due to the deformation of the elastic film unit 36 is permitted. That is, if the piezoelectric vibrator 20 is contracted, accordingly, the island unit 35 is displaced to the side (opposite side to the nozzle plate 24) separated from the pressure chamber 28. Accordingly, the pressure chamber 28 dilates from the reference volume corresponding to the reference electric potential Vb to the maximum volume corresponding to the maximum electric potential Vmax. By this dilation of the pressure chamber 28, the meniscus exposed to the nozzle 30 is drawn into the pressure chamber side. The dilated state of the pressure chamber 28 is held constant over the time period when the dilation holding element p2 is applied. During this time, since the piezoelectric vibrator 20 is held in the contracting state, the island unit 35 also stays in that position. If the contracting element p3 is applied to the piezoelectric vibrator 20 sequentially after the dilation holding element p2, the piezoelectric vibrator 20 expands to the maximum limit or almost to the maximum limit. Along this, the island unit 35 is rapidly displaced towards the side (nozzle plate 24 side) close to the pressure chamber 28. Accordingly, the pressure chamber 28 rapidly contracts from the maximum volume to the minimum volume corresponding to the minimum electric potential Vmin. The ink in the pressure chamber 28 is pressurized by the rapid contraction of the pressure chamber 28, and so that several p1 to several tens of p1 of ink is ejected from the nozzles 30. The contracted state of the pressure chamber 28 is held for a short time over the time period when the contracting holding element p4 is applied. During this time, since the piezoelectric vibrator 20 is held in the expanded state, the island unit 35 also stays in that position. After that, the returning element p5 is applied to the piezoelectric vibrator 20 and the piezoelectric vibrator 20 contracts. Along with this, the island unit 35 is displaced to the normal position corresponding to the reference electric potential Vb. Accordingly the pressure chamber 28 returns to the reference volume.

Figure 7A:
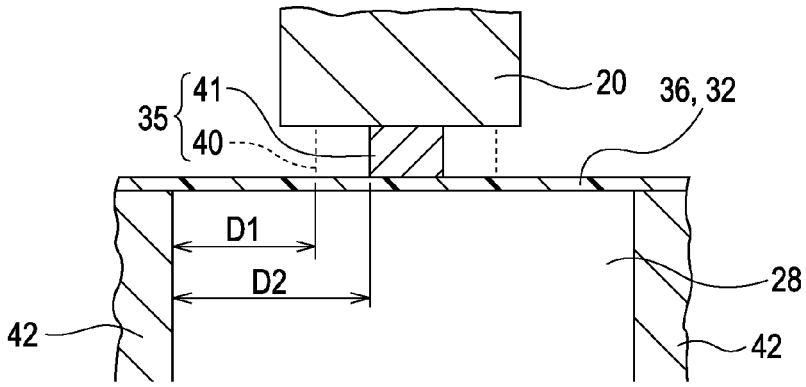
FIGS. 7A and 7B are cross-sectional diagrams of main parts, in the nozzle array direction, of a center portion of a pressure chamber in the longitudinal direction.
Figure 7B:
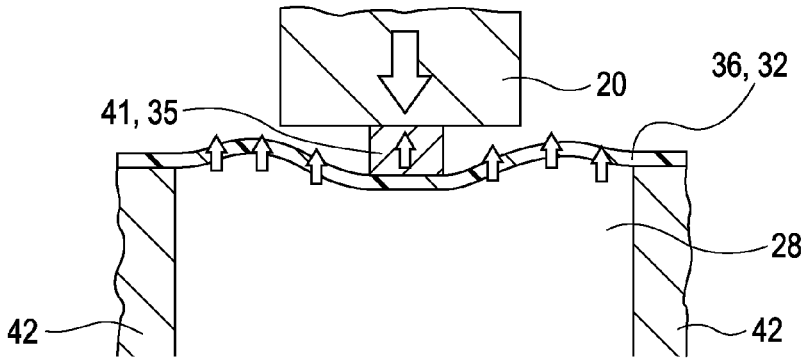

FIGS. 7A and 7B are cross-sectional diagrams of main parts, in the nozzle array direction, of a center portion of a pressure chamber 28 in the longitudinal direction, in which FIG. 7A shows a normal state (a state in which the applied electric potential of the piezoelectric vibrator 20 is the reference electric potential Vb), and FIG. 7B shows a state in which the piezoelectric vibrator 20 is expanded. Herein, when the piezoelectric vibrator 20 is expanded and contracted, particularly when the piezoelectric vibrator is expanded, the reaction force received from the island unit 35 is easy to concentrate to the center portion of the joint surface of the piezoelectric vibrator 20 and the island unit 35. In this kind of recording head in the related art, the piezoelectric vibrator is deformed due to the reaction force received from the island unit, and the normal ejecting of the ink was difficult in some cases. However, in the recording head 2 according to the embodiments of the invention, since the width of the narrow width portion 41 in the center portion of the island unit 35 in the longitudinal direction is set to be narrower than the width of the wide width portions 40 in both end portions of the island unit in the longitudinal direction, the joint area with the piezoelectric vibrator 20 in the center portion of the island unit 35 is smaller than the related art, and the reaction force received from the island unit 35 when the piezoelectric vibrator 20 expands and contracts can be reduced. That is, by employing this configuration, as shown in FIG. 7A, a distance D2 from the wall 42 to the narrow width portion 41 is longer than a distance D1 (or, distance from the pressure chamber wall to the island unit of the recording head in the related art) from the wall 42 which partitions the pressure chamber 28 to the wide width portion 40. To that extent, the range of the elastic film unit 36 becomes wider, and the reaction force (black arrows in the FIGS. 7A and 7B) when the piezoelectric vibrator 20 expands and contracts tends to be absorbed by the elastic deformation of the elastic film unit 36. Accordingly, the reaction force with respect to the piezoelectric vibrator 20 can be reduced. As a result, the deformation of the piezoelectric vibrator 20 due to the reaction force is prevented, and the adverse influence on the ink ejection due to the deformation of the piezoelectric vibrator 20 can be suppressed. Meanwhile, since the width of the wide width portions 40 of both end portions of the island unit 35 is wider than the width of the narrow width portion 41 of the center portion, the displacement of the piezoelectric vibrator 20 in an expandable manner can be efficiently converted to the volume fluctuation of the pressure chamber 28. Therefore, it is possible to eject the desired amount of ink from the nozzles 30.

In the printer 1 on which the recording head 2 is mounted, since it is possible to arrange the nozzles 30 with a high density, it is possible to provide the recording images and the like at a high resolution. Further, since it is possible to make the thickness of the substrate of the piezoelectric vibrator 20 thinner than the related art, the cost can be reduced.

The invention is not limited to the embodiments described above, and various modifications can be made based on the descriptions of claims.

For example, the shape of the island unit 35 is not limited to the example shown in FIG. 5.

Figure 8:
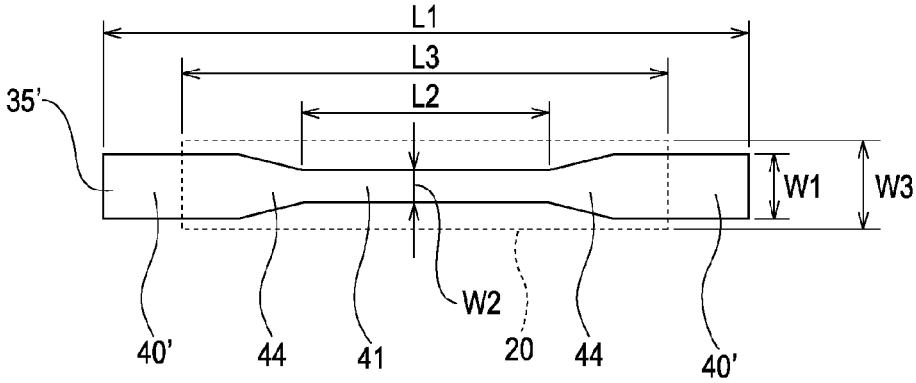
FIG. 8 is a plane view explaining a configuration of an island unit of a second embodiment.

FIG. 8 is a plane view explaining a configuration of an island unit 35' of a second embodiment. The island unit 35' in this embodiment, includes wide width portions 40' which are positioned at both end portions in the longitudinal direction, and have constant width as W1, a narrow width portion 41 which is positioned at the center portion in the longitudinal direction and has a constant width as W2 (W2<W1), and a connection portions 44 which are positioned between the wide width portion 40' and a narrow width portion 41, and of which the widths gradually become narrower from W1 to W2 when it goes from the wide width portion 40' side to the narrow width portion 41 side. A piezoelectric vibrator 20 is connected to the island portions 35' in a state in which at least a part of the piezoelectric vibrator overlaps both sides of the wide width portions 40'. Since the other configurations are the same as the first embodiment, the detailed descriptions are omitted. In the configuration, the same effects are obtained as the first embodiment. To summarize, as long as the configuration is such that the width of the center portion of the island portion in the longitudinal direction is set to be narrower than the width of both end portions of the island unit in the longitudinal direction, an arbitrarily-shaped island unit can be employed.

Figure 9:
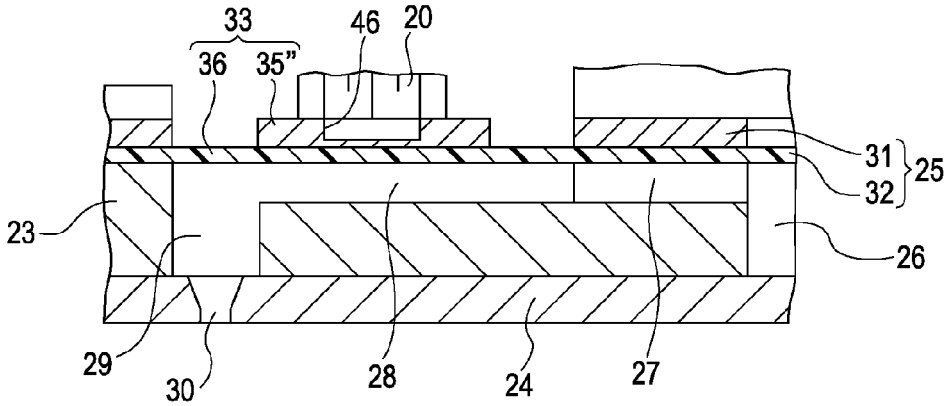
FIG. 9 is a cross-sectional diagram of main parts of the vicinity of a pressure chamber of a third embodiment.
Figure 10:
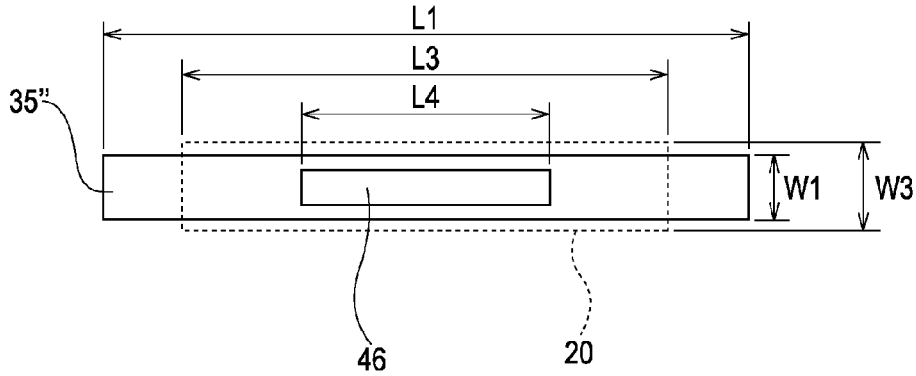
FIG. 10 is a plane view explaining a configuration of an island unit of a third embodiment.

FIG. 9 is an enlarged cross-sectional diagram of the vicinity of a pressure chamber 28 of a third embodiment. FIG. 10 is a plane view explaining a configuration of an island unit 35" of a third embodiment. The island unit 35" of the embodiment has a rectangular parallelepiped shape wherein the width is approximately constant, as similar to the island unit employed in the recording head in the related art, however, it is different from the island units in the related art and the island units of each embodiments, in a point in which a recessed portion 46 is formed on the center portion of the joint surface with the piezoelectric vibrator 20, towards to the opposite surface side (pressure chamber 28 side) of the joint surface side. The opening shape of the recessed portion 46 has a rectangular shape, and the depth thereof is slightly shallower than the thickness of the island unit 35. Alternatively, the recessed portion 46 may penetrate the thickness direction of the island unit 35. Further, an inside dimension L4 of the recessed portion 46 in the longitudinal direction is shorter than the dimension L3 of the piezoelectric vibrator 20. According to this configuration, since a portion of the island unit 35 corresponding to the recessed portion 46 is not joined to the tip portion of the piezoelectric vibrator 20, the reaction force received from the island unit 35 when the piezoelectric vibrator 20 expands and contracts can be reduced. The reaction force at this time is absorbed by the elastic deformation of the thin-walled portion of the bottom portion of the recessed portion 46 and the elastic film unit 36 corresponding to the thin-walled portion, when the recessed portion 46 does not penetrate the island unit 35. When the recessed portion 46 penetrates the island unit 35, the reaction force is absorbed by the elastic deformation of the elastic film unit 36 corresponding to the recessed portion 46. Thus, the same effects to the embodiments can also be obtained by the above configuration.

Hereinabove, the ink jet type printer 1 as a kind of liquid ejecting apparatus is described as an example, however, the embodiments of the invention can be also applied to the other liquid ejecting apparatus in which the volume of the pressure chamber is fluctuated so as to eject the liquid from the nozzles by displacing the island unit by the piezoelectric vibrator. For example, it is possible to be applied to a display manufacturing apparatus manufacturing color filters such as liquid crystal displays, an electrode manufacturing apparatus forming the electrode such as electroluminescence display or FED (Field Emission Display), a chip manufacturing apparatus manufacturing biochips, and a micropipette preciously supplying extremely small amounts of a sample solution.

The entire disclosure of Japanese Patent Application No. 2011-158838, filed Jul. 20, 2011 is incorporated by reference herein.

What is claimed is:

1. A liquid ejecting head comprising:

a pressure chamber which communicates with a nozzle;

a diaphragm unit which partitions a part of the pressure chamber, the diaphragm unit including an elastic film unit which seals an opening portion of the pressure chamber, and an island unit which is provided on the elastic film unit; and a piezoelectric vibrator which displaces the diaphragm unit, the piezoelectric vibrator being joined to the island unit which has a longitudinal direction, wherein a width of a center portion of the island unit is set to be narrower than a width of both end portions of the island unit, the width of the center portion of the island unit being constant, a dimension of the center portion of the island unit in the longitudinal direction is shorter than dimension of the piezoelectric vibrator in the same direction, and the width of both end portions of the island unit is narrower than a width of the piezoelectric vibrator.

2. A liquid ejecting apparatus comprising the liquid ejecting head according to claim 1.

3. A liquid ejecting head comprising:

a pressure chamber which communicates with a nozzle;

a diaphragm unit which partitions a part of the pressure chamber, the diaphragm unit including an elastic film unit which seals an opening portion of the pressure chamber, and an island unit which is provided on the elastic film unit; and a piezoelectric vibrator which displaces the diaphragm unit, the piezoelectric vibrator being joined to the island unit which has a longitudinal direction, wherein the island unit has a recessed portion along the longitudinal direction of the island unit, in a center portion of a joint surface of the island unit with the piezoelectric vibrator, and wherein the recessed portion is a blind hole which is open towards the joint surface.

4. A liquid ejecting apparatus comprising the liquid ejecting head according to claim 3.

* * * * *